US007048499B2

(12) United States Patent
Mathson et al.

(10) Patent No.: US 7,048,499 B2
(45) Date of Patent: May 23, 2006

(54) IN-LINE CENTRIFUGAL FAN

(75) Inventors: Timothy R. Mathson, Mosinee, WI (US); Timothy D. Kuski, Mosinee, WI (US)

(73) Assignee: Greenheck Fan Corporation, Schofield, WI (US)

( * ) Notice: Subject to any disclaimer, the term of this patent is extended or adjusted under 35 U.S.C. 154(b) by 0 days.

(21) Appl. No.: 10/297,450

(22) PCT Filed: Jun. 14, 2001

(86) PCT No.: PCT/US01/19105

§ 371 (c)(1),
(2), (4) Date: May 20, 2003

(87) PCT Pub. No.: WO01/96745

PCT Pub. Date: Dec. 20, 2001

(65) Prior Publication Data

US 2003/0206800 A1 Nov. 6, 2003

Related U.S. Application Data

(60) Provisional application No. 60/211,741, filed on Jun. 15, 2000.

(51) Int. Cl.
*F04D 29/38* (2006.01)

(52) U.S. Cl. ..... 415/119; 415/206; 415/209.3; 415/209.4; 415/211.2; 415/218.1; 415/219.1; 415/229; 416/186 R; 416/188; 416/223 B; 416/DIG. 2

(58) Field of Classification Search ..... 415/119, 415/206, 208.1, 209.3, 209.4, 210.1, 211.1, 415/211.2, 218.1, 219.1, 229, 220; 416/185, 416/186 R, 188, 189, 223 B, DIG. 2
See application file for complete search history.

(56) References Cited

U.S. PATENT DOCUMENTS

| | | | | |
|---|---|---|---|---|
| 2,856,118 | A | 10/1958 | Smith | |
| 3,069,071 | A | 12/1962 | Carlson | |
| 3,102,679 | A * | 9/1963 | Rudy | 415/218.1 |
| 3,312,386 | A | 4/1967 | Hull et al. | |
| 3,584,968 | A | 6/1971 | Keith | |
| 3,650,633 | A | 3/1972 | Benoit | |
| 4,218,190 | A * | 8/1980 | Nishikawa et al. | 416/186 R |
| 4,647,271 | A * | 3/1987 | Nagai et al. | 416/186 R |

(Continued)

FOREIGN PATENT DOCUMENTS

DE 4023724 4/1991

(Continued)

OTHER PUBLICATIONS

Loren Cook, CV—Inline and Vertical Upblast Fans, www.lorencook.com.

*Primary Examiner*—Christopher Verdier
(74) *Attorney, Agent, or Firm*—Quarles & Brady LLP

(57) ABSTRACT

An inline centrifugal mixed flow fan (20) includes an axially extending intake conduit (22). An inlet cone (28) is disposed at an intake end (24). An impeller (30) is disposed downstream of the inlet cone and includes a centrally disposed wheel-back (32) rotated by an electric motor (44), plural fan blades (34) extending radially outwardly from the wheel-back and a wheel cone fixedly (36) attached to and circumscribing the wheel blades. A driver chamber (48) downstream of the impeller includes plural radially extending straight vanes (50) to direct air to an outlet end (26). The fan is configured to achieve reduced sound level and increased efficiency.

24 Claims, 8 Drawing Sheets

U.S. PATENT DOCUMENTS

| | | | | |
|---|---|---|---|---|
| 4,828,456 | A | 5/1989 | Bodzian | |
| 5,336,050 | A * | 8/1994 | Guida et al. | 416/186 R |
| 5,810,557 | A | 9/1998 | Akinkuotu et al. | |
| 6,042,335 | A | 3/2000 | Amr | |

FOREIGN PATENT DOCUMENTS

| | | | | |
|---|---|---|---|---|
| FR | 1224941 A * | 6/1960 | | 415/209.4 |
| GB | 1030055 A * | 5/1966 | | 415/209.4 |

* cited by examiner

IN-LINE CENTRIFUGAL FAN

CROSS-REFERENCE TO RELATED APPLICATIONS

This application claims the benefit provisional U.S. application 60/211,741, entitled "In-Line Centrifugal Fan" which was filed on Jun. 15, 2000, the disclosure of which is hereby incorporated by reference as if set forth in its entirety herein.

STATEMENT REGARDING FEDERALLY SPONSORED RESEARCH OR DEVELOPMENT

Not applicable.

BACKGROUND OF THE INVENTION

The present invention relates generally to an in-line centrifugal fan, and in particular, relates to a mixed flow fan having a high operating efficiency and reduced sound output, and that is easy to manufacture and service.

In-line fans are generally classified according to the direction of airflow through the impeller. In particular, axial flow fans are characterized by flow through the impeller in a direction generally parallel to the shaft axis. In-line centrifugal fans receive airflow into the impeller axially, and redirect the airflow radially outward. Mixed flow fans are characterized in that the air enters the impeller axially and is deflected at an obtuse angle by the impeller blades such that the air flowing out of the impeller has both axial and radial flow components.

The performance and desirability of a fan is measured generally by the fan's efficiency and sound levels produced during operation. The optimization of these two components will reduce the energy needed to operate the fan, thus conserving cost, and will further reduce the noise pollution associated with operation as frequent exposure to high levels of noise pollution has been linked to various health problems in humans and is generally annoying. One leading mixed flow fan in the industry was commercially introduced in 1997 as the leading fan in the industry in terms of high efficiency and low sound levels. This fan was tested in accordance with standards adopted by the Air Movement and Control Association to determine the fan's efficiency and sound power output under various operating conditions, such as fan static pressure (water gauge) and flow rate, measured in cubic feet per minute (CFM). The sound pressure level was reported in dBA, and fan static efficiency was determined as 100%*(CFM×static pressure)/(6,356×BHP). The brake horsepower (BHP) was measured once the fan had reached steady state operation. As illustrated in Table 1, the smallest prior art fan tested circulates air at 4100 cubic feet per minute, operates at an efficiency of 36%, and produces a sound pressure level of 82 dBA in applications requiring one inch water gauge of fan static pressure. The relatively low efficiency and high sound level of this fan leaves significant room for improvement in the industry.

TABLE 1

| | Prior Art Fan | | | | | | | | |
|---|---|---|---|---|---|---|---|---|---|
| | 1" | | | 2" | | | 3" | | |
| CFM | BHP | Eff. | DBA | BHP | Eff. | DBA | BHP | Eff. | dBA |
| 4100 | 1.78 | 36% | 82 | 2.60 | 50% | 83 | 3.46 | 56% | 85 |
| 6100 | 2.54 | 38% | 83 | 3.79 | 51% | 85 | 5.09 | 57% | 86 |

TABLE 1-continued

| | Prior Art Fan | | | | | | | | |
|---|---|---|---|---|---|---|---|---|---|
| | 1" | | | 2" | | | 3" | | |
| CFM | BHP | Eff. | DBA | BHP | Eff. | DBA | BHP | Eff. | dBA |
| 13200 | 3.88 | 54% | 76 | 6.26 | 66% | 77 | 8.80 | 71% | 78 |
| 20000 | 5.98 | 53% | 80 | 9.57 | 66% | 81 | 13.39 | 70% | 82 |

It is further desirable for in-line centrifugal fans to be easy to install and service. For example, fans are typically installed within ductwork to circulate air throughout a building, and should be easily attachable and detachable to allow the fan to be easily serviced. Currently, additional parts are needed to install the fans, including separate angle rings and flexible duct connectors that are used to eliminate the transmission of vibration from the fan. Furthermore, servicing conventional fans' internal drive components has typically been limited and cumbersome due to the limited accessibility to their internal drive components, which requires the removal, and disassembly, of other internal components. Subsequently, the non-modular moveable parts need to be reinstalled within the fan, which is difficult given the small internal confines of the fan.

What is therefore needed is an improved mixed flow fan that produces lower sound levels during operation, and that is more efficient to operate. It is further desirable to provide such a fan that is relatively easy and efficient to install and service.

SUMMARY OF THE INVENTION

In accordance with one aspect of the invention, the fan includes an axially extending conduit having an intake end and an outlet end. An inlet cone is disposed at the intake end and receives air from the ambient environment. An impeller is disposed downstream of the inlet cone and includes A) a centrally disposed wheel-back configured for rotation by an electric motor, B) a plurality of fan blades extending radially outwardly from the wheel-back that force air in the direction from the intake end to the outlet end; and C) a wheel cone fixedly attached to, and circumscribing the wheel blades. A drive chamber disposed downstream of the impeller includes a plurality of radially extending straightening vanes operable to receive the forced air from the impeller and direct the air substantially axially downstream to the outlet end.

In accordance with another aspect of the invention, the inlet cone has a discharge diameter of approximately between 0.68 and 0.83 times the diameter defined by radial outermost edges of opposing fan blades. The geometric configuration of the inlet cone contributes to the fan's enhanced aerodynamic and acoustic performance, thereby resulting in reduced sound levels and increased efficiency during operation when compared to conventional inline centrifugal fans.

In accordance with another aspect of the invention, the inlet cone has a discharge angle of between 30° and 40°, and matches the conical angle of the wheel cone.

In accordance with another aspect of the invention, the straightening vanes have a camber radius substantially between 0.50 and 0.61 times the diameter defined by radial outermost edges of opposing fan blades.

In accordance with another aspect of the invention, each straightening vane has a leading edge angle substantially between 30° and 40°.

In accordance with another aspect of the invention, the fan includes a modular bearing assembly that extends within the conduit. The bearing assembly includes a shaft that is driven by the electric motor. The shaft, in turn, drives the impeller and first and second bearing plates mounted within the drive chamber. The bearing assembly is removable from the conduit as a unitary assembly, which allows the fan to be easily serviced when access to the fan's internal drive components has been quite limited and cumbersome in conventional inline centrifugal fans.

In accordance with another aspect of the invention, a duct connector is disposed proximal the intake end and is unitary with the conduit. The duct connector is configured to provide a slip-fit connection with ductwork in a building, thereby allowing the fan to be installed in a building, for example, with greater ease than inline centrifugal fans currently available.

In accordance with another aspect of the invention, a plurality of fan blades extends radially outwardly from the wheel-back. The blades are configured to force air in the direction from the intake end to the outlet end. Each of the blades has a leading edge disposed upstream of a trailing edge, wherein each blade is trapezoidal and has a uniform thickness. Each of the blade surfaces has a radius of curvature substantially between 0.7 and 0.86 times the diameter defined by radial outermost edges of opposing fan blades.

In accordance with another aspect of the invention, the wheel-back, which rotates under forces provided by the electric motor, includes a substantially spherical portion having a radius of substantially between 0.37 and 0.45 times the diameter defined by radial outermost edges of opposing fan blades.

In accordance with another aspect of the invention, each of the straightening vanes includes at least one integral tab extending radially inwardly that is received in a corresponding elongated slot extending through the drive chamber to properly orientate the straightening vanes with respect to the drive chamber.

In accordance with another aspect of the invention, the inlet cone has a throat diameter of substantially 0.61 and 0.75 times the diameter defined by the radial outermost edges of opposing fan blades.

In accordance with another aspect of the invention, the fan blades have a leading edge and a trailing edge, extend radially outwardly from the wheel-back at a wheel-back edge, and are connected to the wheel cone at a wheel cone edge. A blade angle between 22° and 32° is formed between the wheel-back edge proximal the leading edge and a line extending tangentially with respect to wheel-back at the interface between the wheel-back and leading edge in the direction of wheel-back rotation.

In accordance with another aspect of the invention, a blade angle between 35 and 45° is formed between the wheel-back edge proximal the trailing edge and a line extending tangentially with respect to wheel-back at the interface between the wheel-back and the trailing edge in the direction of wheel-back rotation.

In accordance with another aspect of the invention, a blade angle between 22° and 32° is formed between the wheel cone edge proximal the leading edge and a line extending tangentially with respect to wheel cone at the interface between the wheel cone and the leading edge in the direction of wheel cone rotation.

In accordance with another aspect of the invention, a blade angle between 27° and 37° is formed between the wheel cone edge proximal the trailing edge and a line extending tangentially with respect to wheel cone at the interface between the wheel cone and the trailing edge in the direction of wheel cone rotation.

Each of these aspects independently and/or in combination produce a fan that is more efficient and less noisy than conventional fans, and further allow the fan to be more easily installed and serviced when compared to conventional fans.

For example, the present invention produces a fan that is capable of producing sound levels less than 70 decibels when operating with an airflow of substantially 4100 cubic feet per minute and one inch water gauge of fan static pressure. The present invention further produces a fan that is capable of achieving an efficiency of greater than 40% when operating with an airflow at a rate between 4100 and 6100 cubic feet per minute at substantially one inch water gauge of fan static pressure. The present invention further produces a fan that is capable of producing sound levels less than 70 decibels when operating with an airflow at a rate between 4100 and 6100 cubic feet per minute at substantially one inch water gauge of fan static pressure. The present invention further produces a fan that is capable of achieving an efficiency greater than 60% when producing an airflow at a rate between 4100 and 6100 cubic feet per minute at 2 inches water gauge of static pressure. The present invention further produces a fan that is capable of achieving sound levels less than 78 dBA when producing an airflow at a rate between 4100 and 20000 cubic feet per minute at 3 inches of water gauge static pressure. Accordingly, the fan greatly reduces noise pollution with respect to inline centrifugal fans currently available. Furthermore, the increased efficiencies reduce the cost associated with operating the fan compared to inline centrifugal fans currently available.

It should be appreciated that the foregoing and other advantages of the invention will appear from the following description. In the description, reference is made to the accompanying drawings which form a part thereof, and in which there is shown by way of illustration, and not limitation, preferred embodiments of the invention. Such embodiments do not necessarily represent the fall scope of the invention. Accordingly, reference must therefore be made to the claims herein for interpreting the full scope of the invention.

BRIEF DESCRIPTION OF THE DRAWINGS

Reference is hereby made to the following figures in which like reference numerals correspond to like elements throughout, and in which.

DETAILED DESCRIPTION OF THE PREFERRED EMBODIMENT

Figure 1:
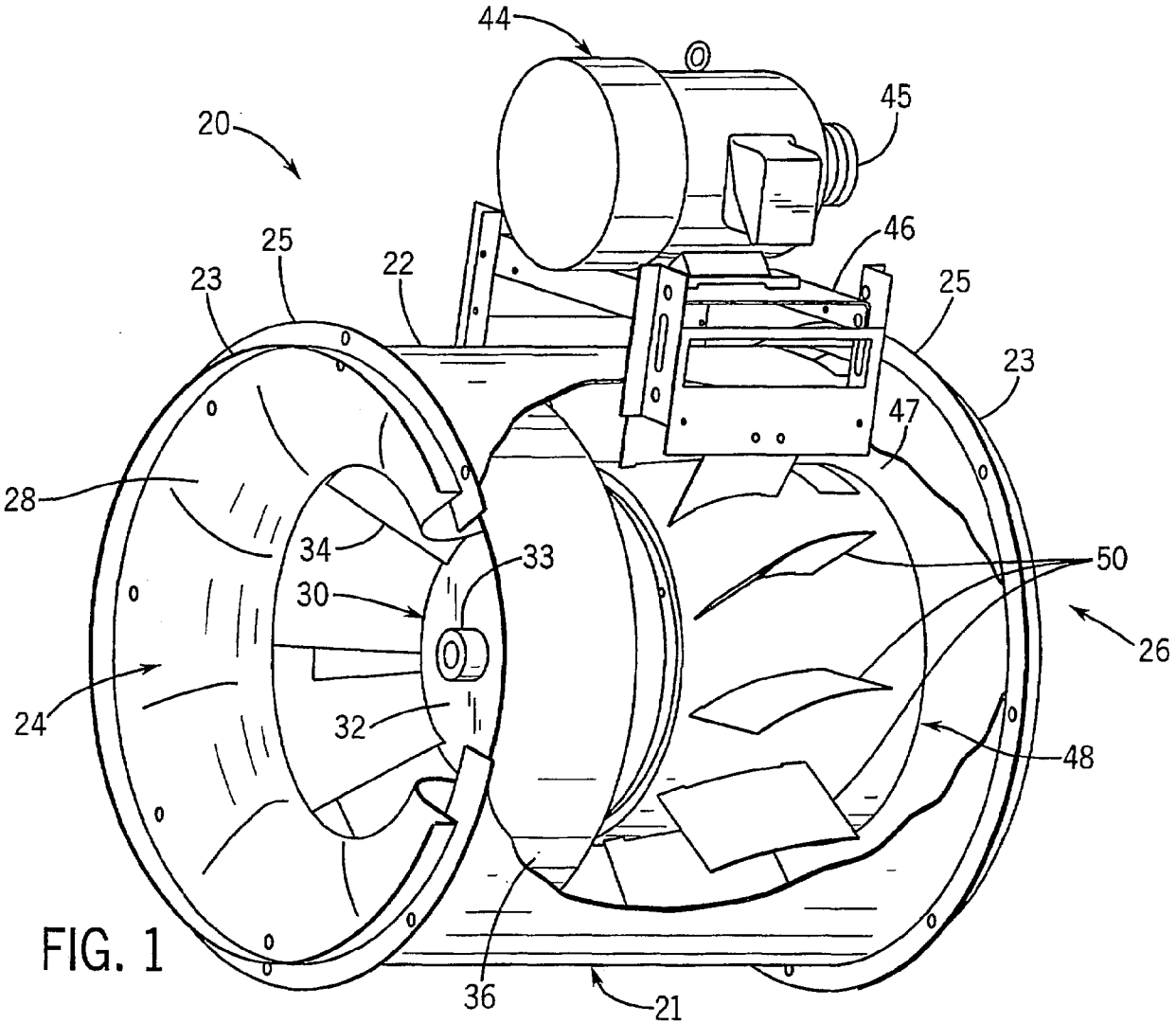
FIG. 1 is a perspective view of a mixed flow fan constructed in accordance with the preferred embodiment having a portion cutaway to illustrate the straightening vanes.
Figure 4:
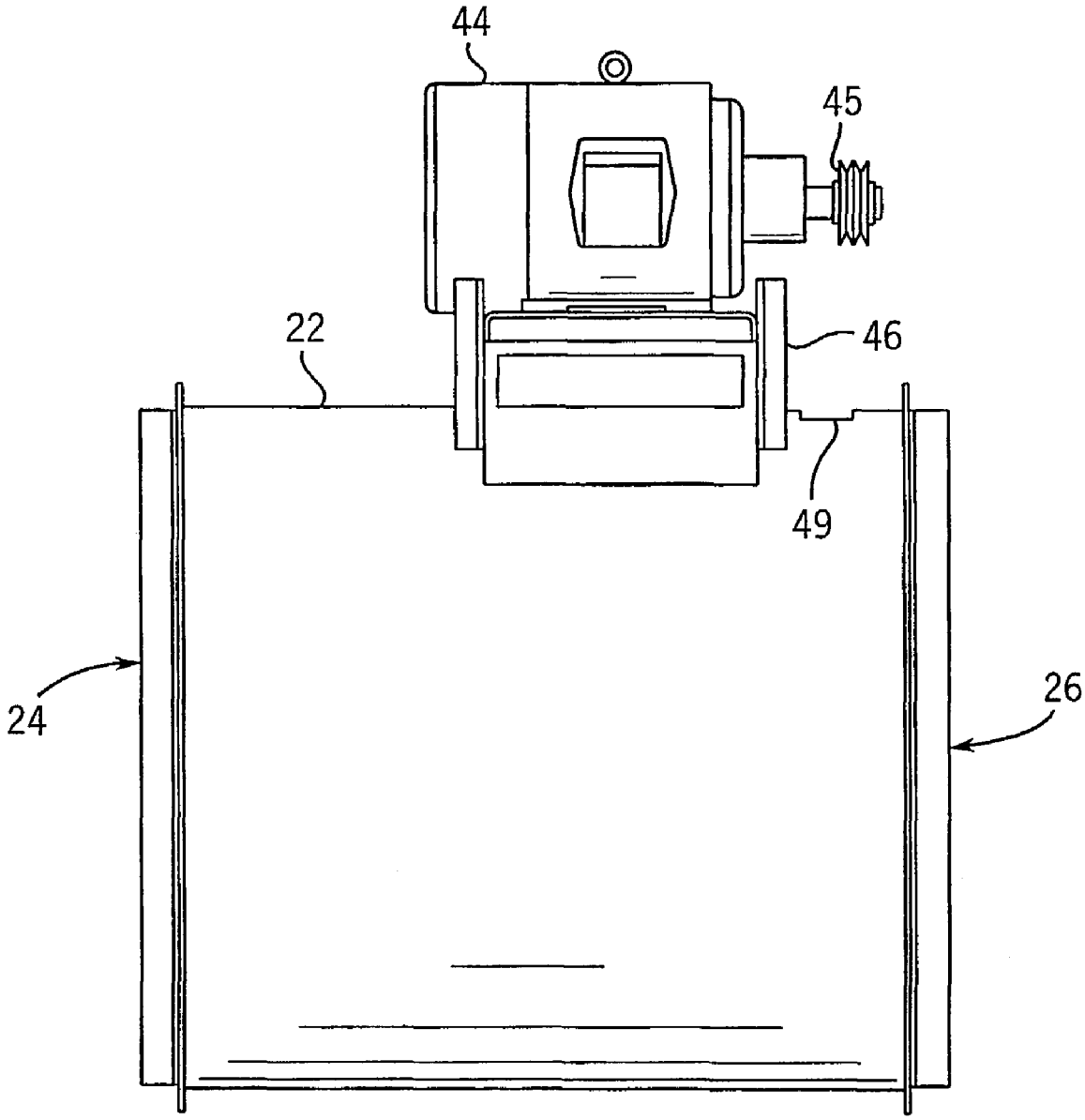
FIG. 4 is a side elevation view of the fan illustrated in FIG. 1.

Referring initially to FIGS. 1 and 4, an in-line centrifugal fan 20, preferably a mixed flow fan, includes a housing 21 defining an annular conduit 22. The conduit 22 includes an air intake end 24 that receives air to be circulated, and an air outlet end 26 downstream of the intake end that expels the air from the fan at a predetermined flow rate. While the fan 20 is a mixed flow fan, it should be appreciated throughout this description that the terms "upstream" and "downstream" are used herein with respect to the flow of air through fan 20 in the axial direction from the intake end 24 towards the outlet end 26. An electric motor 44 is mounted onto the upper surface of housing 21 via a mounting bracket 46 and, during operation, rotates a drive pulley 45 at a predetermined rate. A drive belt (not shown) translates the power from the drive pulley 45 to rotate the corresponding internal components of fan 20, thus circulating air throughout, for example, a building. It should be appreciated that various motor 44 sizes and drive pulley combinations are available to produce fans capable of circulating air at various flow rates, as is illustrated below with reference to Table 2.

Referring still to FIG. 4, the fan 20 may be easily installed in, and subsequently removed from, the ductwork of a building. In particular, the inlet cone 28 includes an integral duct collar 23 that extends axially upstream of the cone and has an outer diameter sized to be received snuggly within the ductwork of a building. Accordingly, an easy slip fit is provided for the ductwork that is to be connected to the fan 20, thereby allowing forced air to be circulated throughout the building. The conduit 22 includes a similar integral duct collar 23 extending axially downstream at the outlet end 26 that is also configured to provide a slip fit with the ductwork. A corresponding pair of radially extending connecting bands 25 is disposed axially inwardly with respect to the flanges 23, and provides a stop when installing the fan 20 into the ductwork. Advantageously, since most comfort HVAC applications use flexible duct connectors to eliminate the transmission of vibration, fan 20 offers an end user a more economical design as separate angle rings are not required for slip fit flexible duct connections.

Referring still to FIG. 1, housing 21 encases the internal active fan components. In particular, an inlet cone 28 is disposed proximal the inlet end 24 and receives air from the ambient environment that is to be circulated by the fan 20. An impeller 30 is rotatably mounted within conduit 22, and is disposed axially downstream of the inlet cone 28. In particular, the impeller 30 includes a wheel-back 32 that rotates under the power of motor 44. The wheel-back 32 presents a spherical convex surface with respect to the air that is flowing through fan 20, as a spherical wheel-back has been shown to provide a greater fan efficiency than conical surfaces. A plurality of fan blades 34 extend radially outwardly and axially upstream from the spherical surface, and preferably are welded to the wheel-back 32. Alternatively, the blades 34 may be connected to the wheel-back 32 via any suitable mechanical fastener. As will become apparent from the description below, the blades 34 and are geometrically configured to create a mixed flow within conduit 22 during operation of the fan 20. Between 7 and 9 blades 34 are used in accordance with the preferred embodiment. The use of 7 blades results in lower operating speed for a given operating point, while 9 blades may be used in accordance with an alternate embodiment to provide a higher pressure capability.

Figure 2:
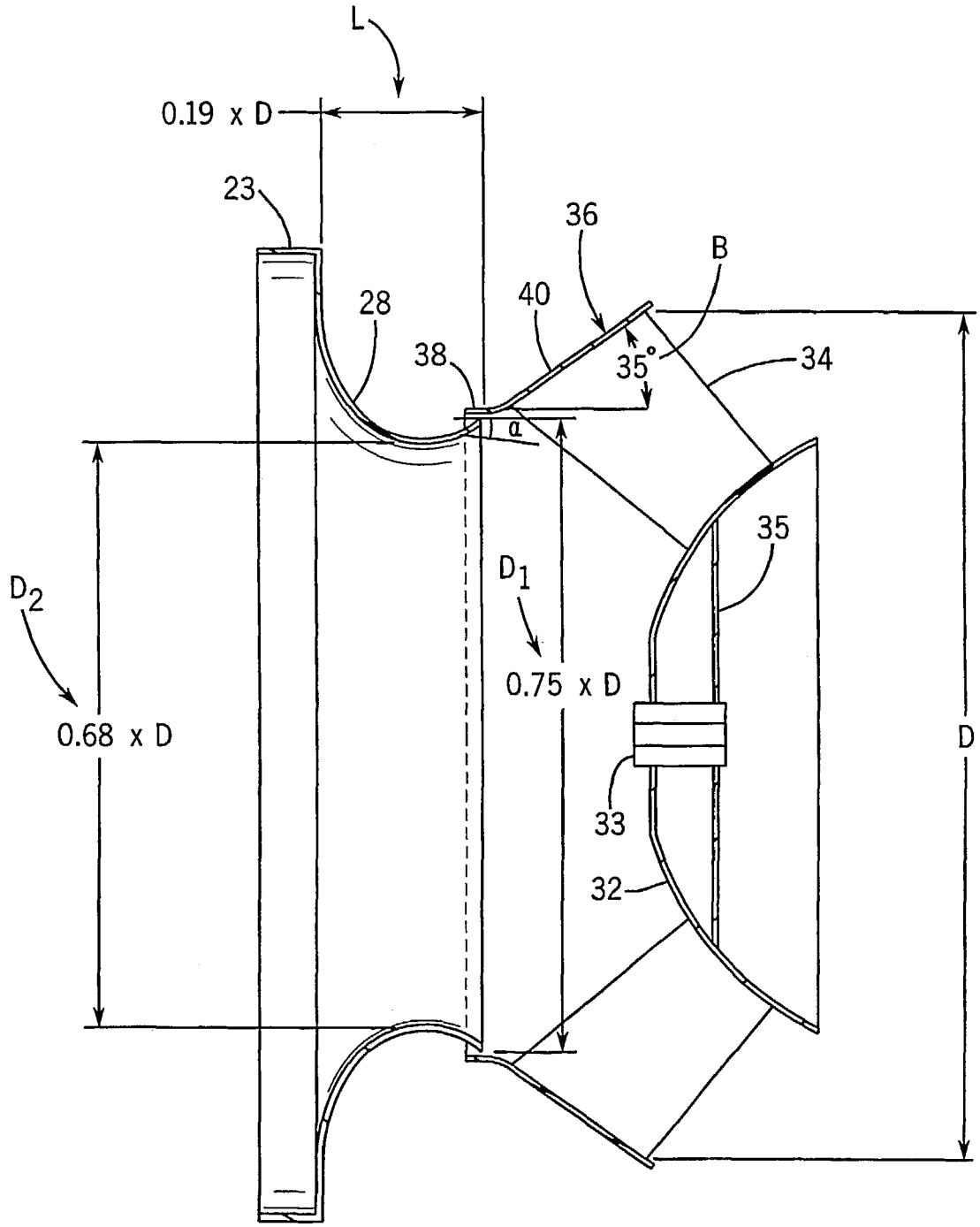
FIG. 2 is a side elevation view of the inlet cone and impeller of the fan illustrated in FIG. 1.

Referring now also to FIG. 2, a generally frusto-conical wheel cone 36 is disposed downstream of, and spaced apart from, the inlet cone 28. Wheel cone 36 includes an axially extending upstream member 38 that is integrally connected to a conical member 40. Conical member 40 is attached to the radially outer edges of fan blades 34, preferably via welding. Accordingly, the wheel cone 36 rotates along with the blades 34 and wheel-back 32 during operation. Upstream member 38 defines an impeller inlet that receives air from inlet cone 28. Accordingly, air to be circulated travels through intake end 24 and into inlet cone 28, and further through the impeller 30 under the forces provided by blades 34 as they rotate. The air circulated by fan 20 is then directed radially and axially downstream from the blades 34. Because the wheel cone 36 is sufficiently spaced apart from the inlet cone 28, the inlet cone 28 will not interfere with wheel cone 36 as it rotates.

Figure 6A:
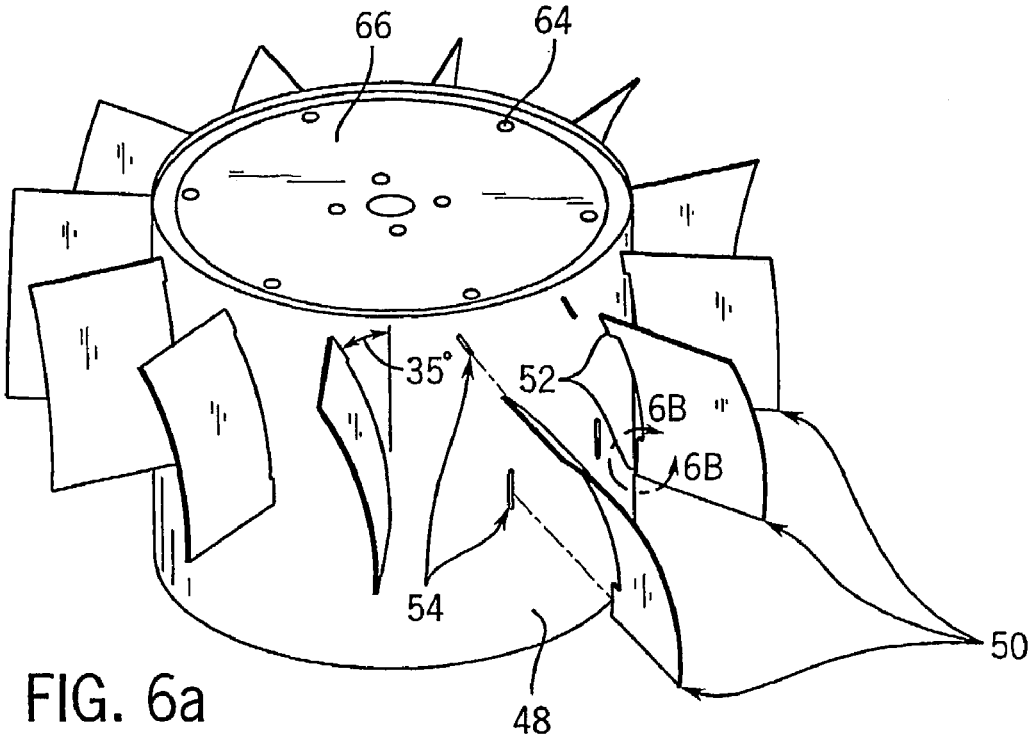
FIG. 6*a* is a perspective view of the straightening vanes being assembled into the drive chamber in the fan illustrated in FIG. 1.
Figure 6B:
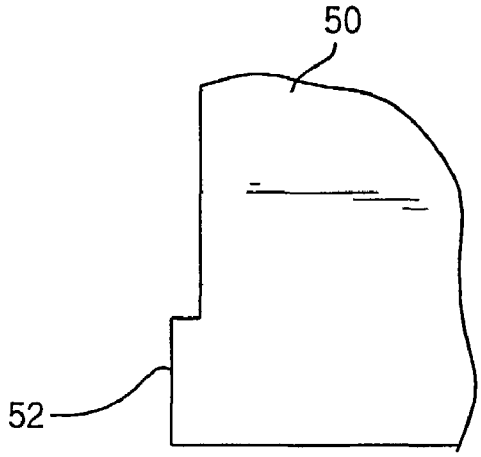
FIG. 6*b* is an enlarged cutaway view of the straightening vanes illustrated in FIG. 6*a;*
Figure 8B:
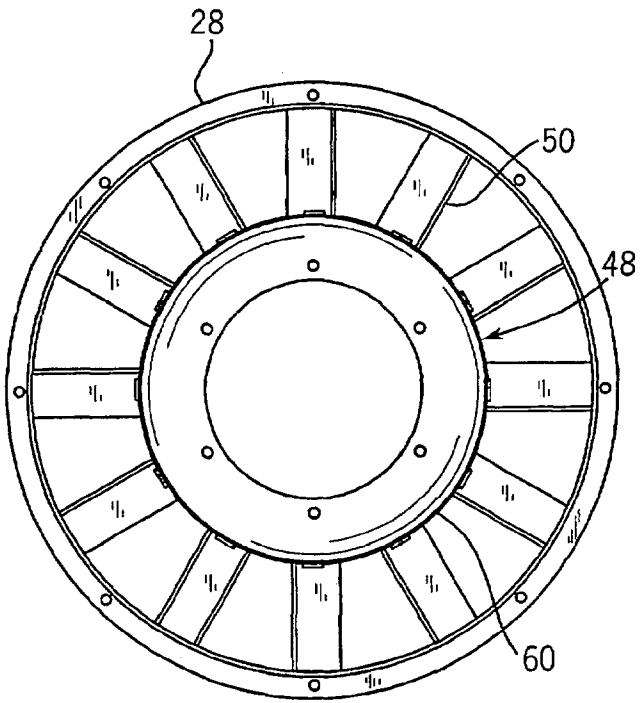
FIG. 8*b* is a sectional rear elevation view of the drive chamber illustrated in FIG. 8*a* taken along the line 8*b*–8*b*.

Referring now also to FIGS. 6A–B and 8B, a cylindrical drive chamber 48 is disposed within conduit 22 and positioned axially downstream of and adjacent wheel-back 32. The chamber 48 is separated from the wheel-back 32 so as to not interfere in the relative rotation between the wheel-back and drive chamber. A plurality of straightening vanes 50 are positioned equidistantly around the outer surface of drive chamber 48 and extend radially outwardly to receive air that travels downstream from the impeller 30. Air circulated by fan 20 exiting the impeller 30 contains a tangential component in addition to the radial and axial components. Straightening vanes 50 serve to redirect the air substantially axially downstream and, as such, convert the otherwise wasted tangential motion of the air to an increase in air pressure at the outlet end 26. The number of straightening vanes 50 is sufficient to ensure a substantially axial discharge while not inhibiting airflow through the vanes 50. While between 11 and 13, and preferably 12 straightening vanes are used in accordance with the preferred embodiment, it should be appreciated that the number of vanes may differ. It should be apparent to one having ordinary skill in the art that it is desirable to minimize the number of straightening vanes while maintaining the static pressure capability of the fan 20. Each straightening vane has a leading edge that is curved with respect to the axial direction, forming a 35° angle, it being appreciated that this angle could be anywhere within the range of 30° and 40° in accordance with the present invention. The straightening vanes transition from the leading edge to a substantially axially extending trailing edge. The camber of the straightening vanes 50 are configured to smoothly receive the air from impeller 30 with minimal disturbance to the airflow. Accordingly, the airflow is smoothly transitioned to an axial flow at the trailing edge to be expelled out the outlet end 26.

Each straightening vane 50 includes a pair of tabs 52 that extend radially inwardly and are received by a corresponding pair of slots 54 in the drive chamber 48 to lock the straightening vane 50 in place. The straightening vanes 50 are then welded in place such that the slots 54 accurately locate the radial spacing of the straightening vanes 50 and control the angle of the leading and trailing edges of the straightening vanes 50 to ensure proper air flow through the straightening vanes 50. It should be appreciated that if the straightening vanes 50 are not accurately positioned, the air will become disturbed while passing through the drive chamber 48, thereby increasing noise production and reducing efficiency. The straightening vanes 50 are more easily and reliably assembled in the fan 20 compared to conventional fans, which typically employ either a mounting fixture or jig that are more expensive to manufacture, and more cumbersome to install. The present "slot and tab" relationship allow the straightening vanes 50 to be more easily and accurately manufactured with respect to the prior art.

Figure 5:
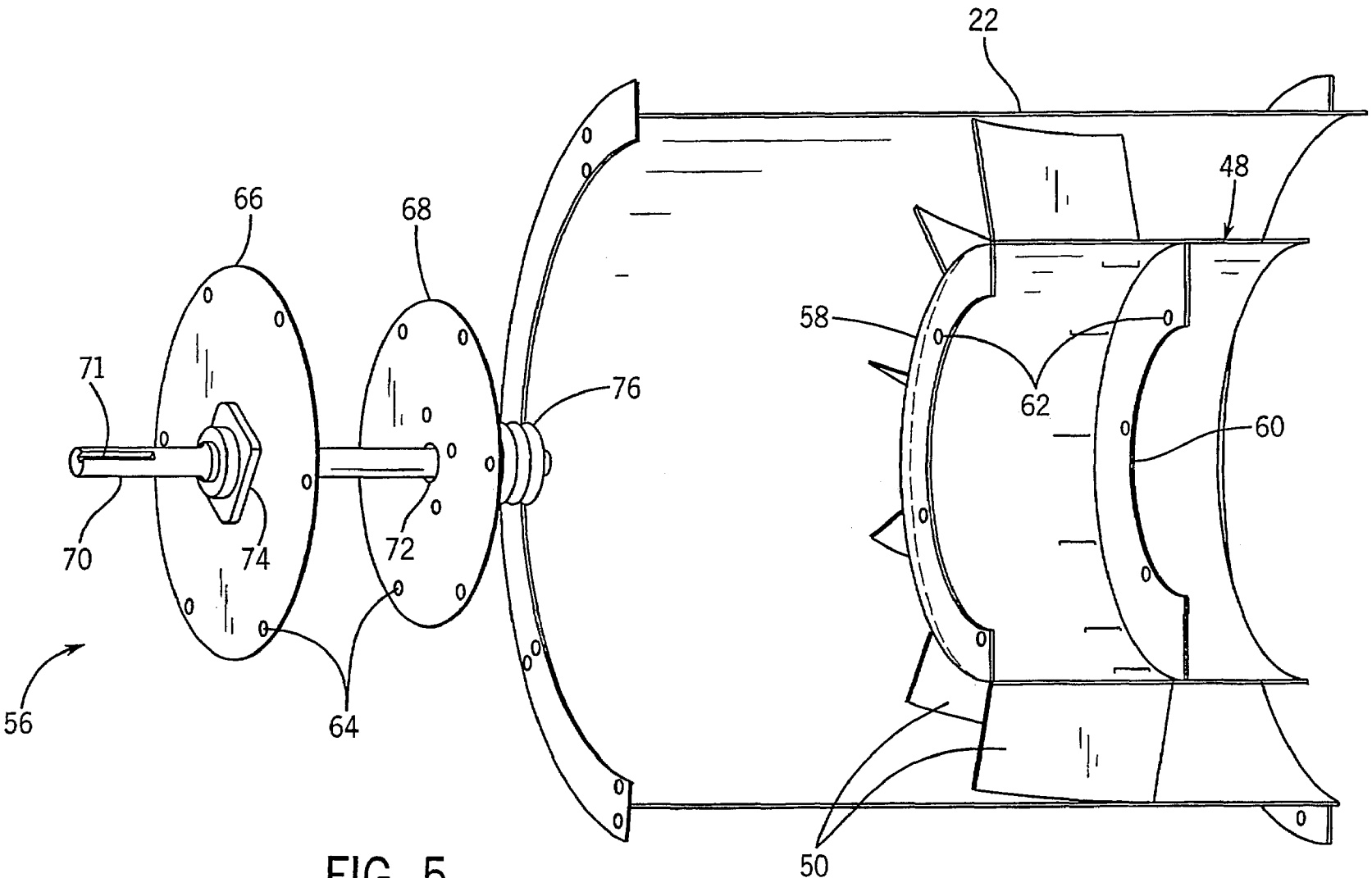
FIG. 5 is an assembly view of the modular bearing assembly of the fan illustrated in FIG. 1.

Referring now to FIG. 5, another significant drawback associated with conventional fans is the difficulty in removing internal parts of the fan in order to provide service. The present invention overcomes these disadvantages by providing a modular bearing assembly 56 that extends through drive chamber 48 and translates the rotational forces imparted by motor 44 to the impeller 30. As will become apparent, the bearing assembly 56 is easily removable from the inlet end 24, which greatly enhances the serviceability of the fan 20. In particular, the drive chamber 48 includes a pair of annular flanges 58 and 60 that extend radially inwardly from the inner surface of chamber 48 and are axially offset from one another such that flange 58 is positioned upstream of flange 60. A plurality of apertures 62 extend through flanges 58 and 60 and are aligned with corresponding apertures 64 that extend through a pair of bearing mounting plates 66 and 68, respectively. Accordingly, upstream mounting plate 66 is mechanically fastened to corresponding upstream flange 58, and downstream mounting plate 68 is fastened to downstream flange 60. Flange 60 presents a smaller inner diameter than flange 58, and mounting plate 68 correspondingly presents a smaller diameter than mounting plate 66. Both mounting plates 66 and 68 have a greater diameter than their respective flange 58 and 60. Accordingly, the bearing assembly 56 is prevented from being over-inserted, and furthermore provides sufficient clearance to allow the bearing assembly 56 to be inserted (and removed) via the inlet end 24.

The mounting plates 66 and 68 rotatably support a driven shaft 70, as will now be described. In particular, a shaft 70 extends axially and concentrically within conduit 22 and through centrally disposed apertures 72 of mounting plates 66 and 68. A first and second bearing 74 is mounted onto the axially upstream face of mounting plate 66, and the axially downstream face of plate 68, respectively at the aperture 72. The bearings 74 thus rotatably support the shaft 70 that extends therethrough and interlock the shaft 70 and mounting plates 66 and 68 with respect to axial movement and facilitate relative rotation between the shaft 70 and each of the mounting plates 66 and 68. A driven pulley 76 is disposed at the downstream end of shaft 70 and, when installed, is axially aligned with drive pulley 45. An aperture 47 (See FIG. 8A) extends through drive chamber 48 and is axially aligned with pulleys 45 and 76 to enable a belt (not shown) to connect the pulleys and drive the shaft 70 upon activation of motor 44. The belt further extends through an aperture 49 that extends through conduit 22 (See FIG. 4) and is radially aligned with aperture 47 to allow the belt to pass unobstructed between pulleys 45 and 76.

As illustrated in FIG. 2, a hub 33 extends axially through the flat central portion of wheel-back 32 and is further supported by an internal mounting plate 35 extending radially within the wheel-back. Hub 33 is annular, and sized to receive the shaft 70. A square steel key (not shown) is inserted into an axially extending slot 71 disposed at the upstream end of shaft 70 and a corresponding axially extending slot in the interior of hub 33 to fix the radial motion of impeller 30 with respect to the shaft 70. Accordingly, activation of motor 44 will correspondingly rotate the impeller 30, thus allowing blades 34 to circulate air through the fan 20.

Having now described the components of fan 20, additional features of the fan that further enable enhanced performance over conventional inline centrifugal fans will now be described.

The following describes various dimensions and ranges for various parts of the fan that both independently, and in combination, achieve certain advantages over the prior art. It should be appreciated that the dimensions and ranges are approximate to reflect changes due to tolerances in manufacturing as is easily appreciated by one having ordinary skill in the art. In particular, the sound levels produced by fan 20 are magnitudes less than prior art fans, and the efficiency of fan 20 is greatly increased with respect to conventional fans. As will become more apparent from the description below, a preferred value is disclosed for a given dimension that has been designed to optimize the advantages associated with fan 20. However, preferred ranges are also disclosed for the dimension, it being appreciated that deviating from the preferred value but staying within the disclosed range may slightly decrease the efficiency and increase noise production compared to the optimized value, but nonetheless present an appreciable advantage over the prior art. Accordingly, the present invention is intended to encompass any fan achieving a greater efficiency and/or reduced noise production than the prior art, as defined by the appended claims. Furthermore, as described above, fan 20 is easier to assemble, manufacture, and install than the prior art.

As described herein, the dimensions and ranges of the fan's internal parts are described relative to a reference dimension. In particular, referring to FIG. 2, the distance "D" between radial outermost edges of opposing blades 34 provides a reference for dimensions of other components of fan 20. However, the invention is not to be so narrowly construed. For example, each dimension of each element described may be defined relative to any other element within the fan 20 since the elements are described relative to the common reference, as will become more apparent from the description below. As illustrated below in Table 2 below, a fan may be constructed in accordance with the present invention in several sizes. Accordingly, diameter "D" could be any appropriate distance, depending on the size of the fan 20, using the principles of the present invention. Table 2 illustrates data corresponding to four fans constructed in accordance with the preferred embodiment. However, these are merely representative of the advantages achieved by the present invention, as it is appreciated that other fans may produce an airflow of between 1700 CFM and 75000 CFM. All such fans may be constructed using principles of the present invention, and are within the scope of the present invention as defined by the appended claims.

TABLE 2

| | Examples of Present Invention | | | | | | | | |
|---|---|---|---|---|---|---|---|---|---|
| | 1" | | | 2" | | | 3" | | |
| CFM | BHP | Eff. | DBA | BHP | Eff. | DBA | BHP | Eff. | dBA |
| 4100 | 1.31 | 49% | 67 | 2.13 | 61% | 69 | 3.02 | 64% | 70 |
| 6100 | 1.81 | 53% | 69 | 2.92 | 66% | 70 | 4.25 | 68% | 72 |
| 13200 | 3.52 | 59% | 70 | 5.98 | 69% | 72 | 8.74 | 71% | 74 |
| 20000 | 5.56 | 57% | 74 | 9.14 | 69% | 75 | 13.32 | 71% | 76 |

Significant advantages are achieved by the present invention, as apparent when comparing Tables 1, corresponding to the prior art, and Table 2, corresponding to the present invention. For example, a fan constructed in accordance with the present invention achieves a reduced brake horsepower needed to achieve the same airflow compared to the prior art, thereby resulting in a significantly greater efficiency. Additionally, the present invention achieves a dramatic reduction in sound levels during operation at any given fan static pressure. For example, when operating at 4100 CFM with a one inch water gauge of fan static pressure, the present invention is 13 percentage points more efficient than the prior art, thereby conserving an appreciable amount of energy and operating expense. Furthermore, at this state of operation, the present invention operates at 15 decibels lower than the prior art. Accordingly, the sound pressure emanating from a fan constructed in accordance with the present invention is significantly less than the sound pressure emanated from the prior art, thereby reducing noise pollution and the hazardous health effects known to result therefrom. Again, these measurements were taken in accordance with standards adopted by the Air Movement and Control Association, as is understood by those having ordinary skill in the art.

The improved aerodynamic and acoustic performance of fan 20 is achieved in-part by the design of inlet cone 28 and impeller 30. In particular, referring again to FIG. 2, the inlet cone 28 has a discharge diameter D1 of approximately 0.75*D at its radial outermost edge. D1 has been maximized in order to minimize the air velocity over the transition between the inlet cone 28 and wheel cone 36, and could be anywhere between approximately 0.68*D and 0.83*D in accordance with the present invention. The inlet cone has a throat diameter D2 of approximately 0.68*D, though it could be anywhere within the range of 0.61*D and 0.75*D. The throat diameter was maximized while maintaining a discharge angle$_{\alpha}$, which is described below. The inlet cone 28 has a length L of approximately 0.19*D, but could be anywhere within the range of 0.17*D and 0.21*D. Greater lengths were not shown to increase efficiency, and it is desirable to keep the length L as small as possible so as to produce a compact fan 20. The fan is thus easier to handle than prior art fans, thus enabling easier installation and servicing.

The inlet cone 28 forms a discharge angle a with respect to the axial direction of approximately 35°, but could be anywhere between 30° and 40°. This angle has been designed to match the angle of the wheel cone 36 conical angle β to maintain a high operating efficiency. It should be appreciated that angles α and β are a function of the diameter and length of the wheel cone 36. Angles α and β, both alone and in combination with the design of the other internal fan components, prevent the air from separating from the wheel cone 36 while flowing through the blades 34. This reduces air resistance, thus increasing operating efficiency and reducing sound levels.

Figure 7B:
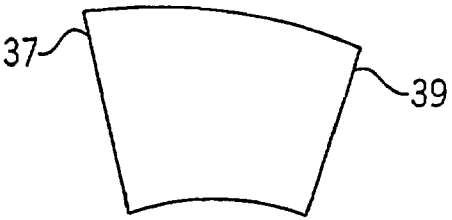
FIG. 7*b* is a side elevation view of a flat blank used to fabricate the blades illustrated in FIG. 7*a;*
Figure 7C:
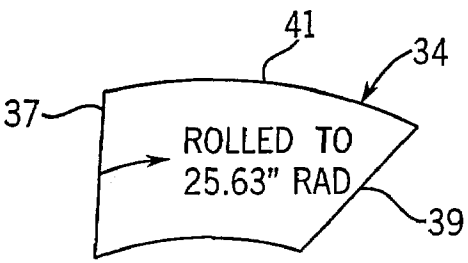
FIG. 7*c* is a side elevation view of a blade formed from the blank illustrated in FIG. 7*b* after rolling.

The dimensions of impeller 30 will now be described in accordance with the preferred embodiment. In particular, as illustrated in FIGS. 7B–C, each blade 34 is formed from a flat sheet of metal steel, but alternatively could be formed from aluminum for spark-proof use in an atmosphere of volatile fumes, that is subsequently rolled or formed into a portion of a cylinder using standard manufacturing processes known in the art. The resulting blade 34 has a uniform thickness rather than an airfoil shape associated with conventional fans which form a narrowed passageway, thus increasing velocity therethrough and drag. These losses are exacerbated in smaller fans. The present invention overcomes these deficiencies by providing the uniform thickness blades 34. Blades 34 are trapezoidal when viewed from the side to aid in the directing airflow in the desired orientation. Each blade has a leading edge 37, a trailing edge 39, and a radially outer wheel cone edge 41 that spans between the leading and trailing edges. Edge 41 is attached to the wheel cone 36.

Figure 3C:
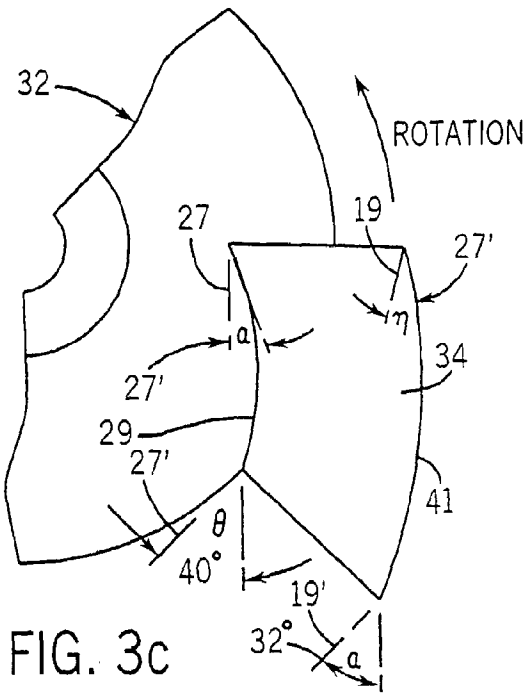
FIG. 3*c* is a cutaway view of the wheel-back and blade showing the angular dimensions of one the blades illustrated in FIGS. 3*a* and 3*b;*
Figure 3B:
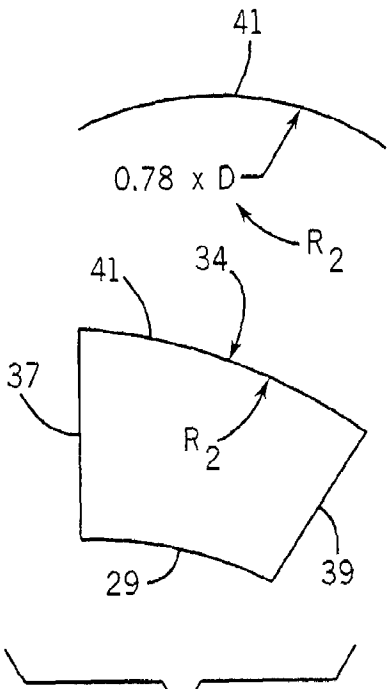
FIG. 3*b* is a side elevation view illustrating the radius of curvature of one of the blades illustrated in FIG. 3*a;*
Figure 3A:
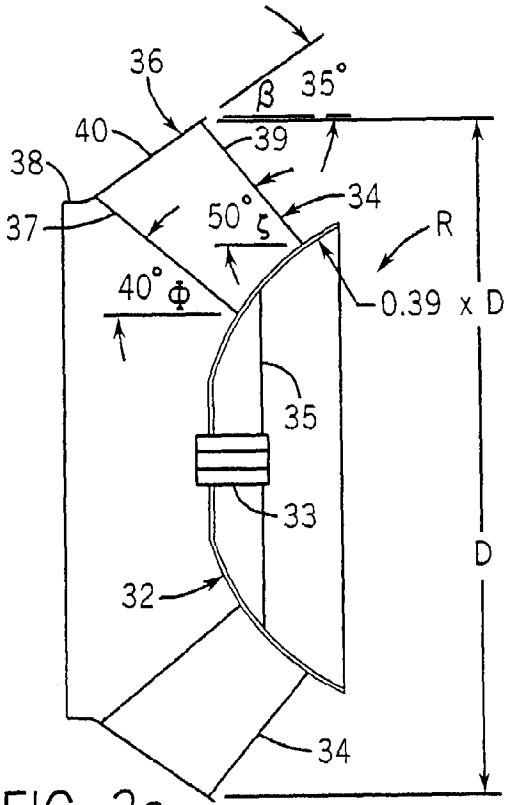
FIG. 3*a* is a sectional side elevation view illustrating the wheel-back and blades of FIG. 2.

As illustrated in FIGS. 3A–C, the trailing edge 39 of each fan blade 34 defines approximately a 50° angle δ with respect to the axial direction, however δ may be anywhere between 45° and 55° in accordance with the present invention. The leading edge 37 defines a 40° angle ϕ with respect to the axial direction, it being appreciated that ϕ could be anywhere between 35° and 45°.

Referring in particular to FIG. 3B, fan blades 34 are formed with a fin camber radius R2 of approximately 0.78*D in accordance with the preferred embodiment, but could be anywhere between 0.7*D and 0.86*D in accordance with the present invention. It has been determined that a smaller camber radius R2 provides greater efficiency, but a larger camber radius provides more airflow. The blades 34 are designed having a first pair of blade angles γ and θ at the wheelback edge 29, and a second pair of blade angles η and ρ at the wheel cone edge 41. In particular, blade angle γ is formed between the wheelback edge 29 proximal the leading edge 37 and a line 27 extending tangentially with respect to wheel-back 32 at the interface between wheel-back and leading edge 37 in the direction of wheel-back movement. Blade angle θ is formed between the wheel-back edge 29 proximal the trailing edge and a line 27' extending tangentially with respect to wheel-back 32 at the interface between the wheel-back and the trailing edge 39 in the direction of wheel-back movement. Blade angle η is formed between the wheel cone edge 41 proximal the leading edge 37 and a line 19 extending tangentially with respect to wheel cone 36 at the interface between the wheel cone and the leading edge 37 in the direction of wheel cone movement. Blade angle ρ is formed between the wheel cone edge 41 proximal the trailing edge and a line 19' extending tangentially with respect to wheel cone 36 at the interface between the wheel cone and the trailing edge 39 in the direction of wheel cone movement. In accordance with the preferred embodiment, blade angle γ is approximately 27°, and alternatively between 22° and 32° while achieving advantages of the present invention. In accordance with the preferred embodiment, blade angle θ is approximately 40°, and alternatively between 35 and 45° while achieving advantages of the present invention. In accordance with the preferred embodiment, blade angle η is 27°, and alternatively between 22° and 32° while achieving advantages of the present invention. In accordance with the preferred embodiment, blade angle ρ is 32°, and alternatively between 27° and 37° while achieving the advantages of the present invention. The blade shape, camber, and blade angles all individually, and collectively, contribute to establishing a geometric configuration sufficient to meet the air slipstreams at the leading edge of the blade and to allow the air to follow the blade with minimal or no separation.

Figure 7A:
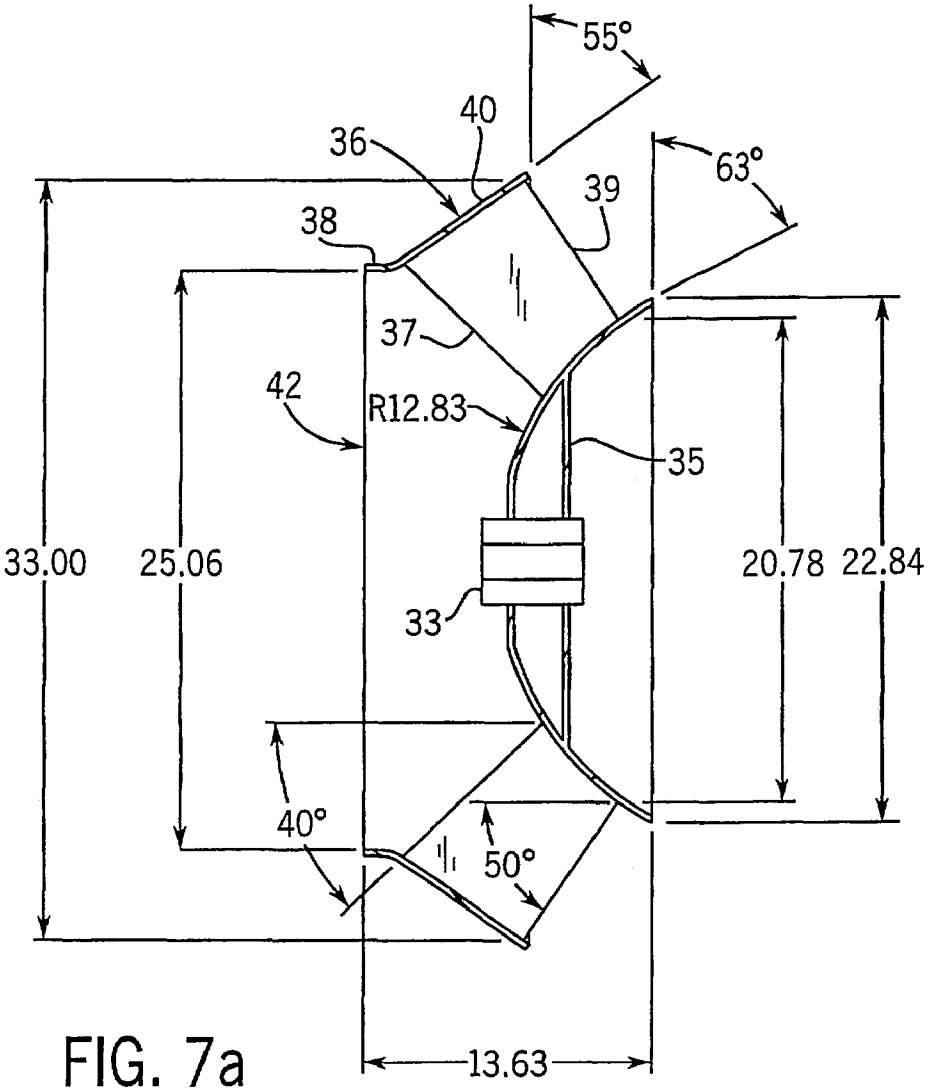
FIG. 7*a* is a sectional side elevation view showing various dimensions of the wheel-back and fan blades illustrated in FIG. 1.
Figure 8A:
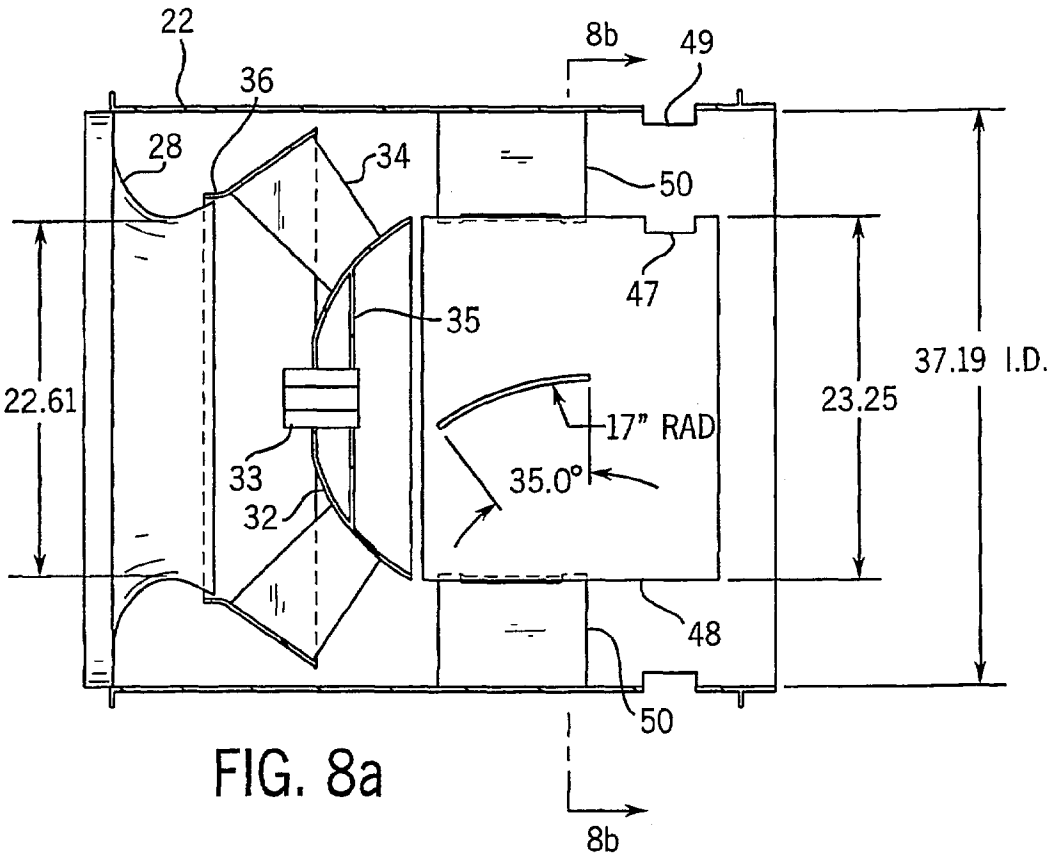
FIG. 8*a* is a sectional side elevation view showing dimensions of the drive chamber and other internal components of the fan illustrated in FIG. 1.

The wheel-back 32 includes an outer spherical portion that surrounds a substantially flat radially extending central hub. The spherical portion is formed from a radius R of approximately 0.39*D, and is thus configured to provide uniform acceleration of the air throughout the wheel and direct the air over the drive chamber 48. It should be appreciated, however, that R could be between 0.37*D and 0.45* D in accordance with the present invention, and is 0.43*D in accordance with the alternate embodiment. It has been found that smaller radii will result in more airflow at a lower static pressure, and larger radii will result in less airflow at a higher static pressure. Referring now to FIGS. 7A and 8A, the dimensions of the various fan components are illustrated (in inches) for a specific size fan constructed in accordance with the preferred embodiment. It should be appreciated, however, that these dimensions may vary significantly without departing from the principles and scope of the present invention. In particular, the scope of the invention includes fans having internal components and associated dimensions that are within the ranges relative to one another described above, thus retaining the reduced sound and increased efficiency achieved in accordance with the present invention.

Referring initially to FIG. 7A, the axial length of the impeller 30 is 13.63 inches, thereby greatly contributing to a fan 20 that is significantly more compact than the prior art. The distance between radially outer edges of fan blades 34 is approximately 33 inches, while the distance between radial outer edges of the wheel-back 32 is approximately 22.84 inches. The distance between the radially inner ends of trailing edges 39 is approximately 20.78 inches. The diameter of the upstream member 38 of wheel cone 36 is 25.06, which is approximately 0.76*D, it being appreciated that it could alternatively be within the range of 0.7*D to 0.8*D, so long as sufficient clearance exists between the wheel cone and the inlet cone 28 without disturbing the air flow. Conical surface 40 of wheel cone 36 forms a 55° angle with respect to the radial direction, and the radial outer ends of wheel-back 32 form a 63° angle with respect to the radial direction.

Referring now to FIG. 8A, the throat of inlet cone 28 has a diameter of 22.61 inches. The diameter of the drive chamber 48 is 23.25 inches, which is approximately 0.70*D in accordance with the preferred embodiment, and 0.78*D in accordance with the alternate embodiment, but could alternatively vary between 0.67*D and 0.82*D. This diameter is preferably matched to the diameter of the wheel-back 32 to prevent sudden expansion of air immediately downstream from the wheel-back and associated losses in pressure. The inner diameter of housing 21 is 37.19 inches, or approximately 1.13*D. The housing diameter is minimized in accordance with the preferred embodiment around the impeller 30 to keep the overall fan size to a minimum, and could be anywhere within the range of 1.07*D and 1.19*D. The total axial length of the fan 20 is approximately 47 inches, significantly less than conventional fans. Each straightening vane 50 is constructed with a camber radius of 0.52*D in accordance with the preferred embodiment, and 0.58*D in accordance with the alternate embodiment. The camber radius could, alternatively, be anywhere within the range of 0.5*D and 0.61*D in accordance with the present invention.

When comparing the present invention in Table 2 to the prior art fan noted in Table 1, it is evident that the present variations of the present invention may reduce its efficiency significantly while still maintaining a substantial advantage over the prior art in terms of efficiency. For example, while some variations to the relative dimensions or angles may reduce the efficiency of fan 20 to 40%, this would still be a significant improvement over the prior art when producing an airflow between 4100 and 6100 CFM at 1 inch water gauge of static pressure. Accordingly, the present invention is intended to cover any fans that are capable of achieving efficiencies greater than 40%, and preferably between 49% and 53%, under these operating conditions.

When producing an airflow between 4100 and 6100 CFM at 2 inches water gauge of static pressure, the fan 20 constructed in accordance with the present invention has an efficiency greater than 60%, which is a significant improvement over the prior art. Accordingly, the present invention is intended to cover any fans that are capable of achieving efficiencies greater than 60%, and preferably between 61% and 69%, under these operating conditions.

Furthermore, when fan 20 produces an airflow between 4100 and 6100 CFM at 1 inch water gauge of static pressure, the fan 20 constructed in accordance with the preferred embodiment is capable of operating with a sound pressure level less than 70 dBA. The prior art, as indicated in Table 1, operates at greater than 80 dBA under these operating conditions. Accordingly, the present invention is intended to cover any fan that is capable of operating at less than 70 dBA, and preferably between 67 and 70 dBA, when producing an airflow between 4100 and 6100 CFM at 1 inch water gauge of static pressure.

Furthermore, at 3 inches water gauge of static pressure, the fan 20 constructed in accordance with the present invention is capable of operating with a sound pressure level less than 78 dBA when producing an airflow at any rate between 4100 and 20000 CFM at 3 inches of water gauge static pressure. Upon examination of Table 1, the prior art primarily produces greater than 80 dBA, the exception being at 13200 CFM, where it produces 78 dBA. Accordingly; at any given flow rate, the fan 20 constructed in accordance with the present invention achieves reduced noise pollution when operating at 3 inches water gauge static pressure. The present invention covers fans capable of achieving sound pressure levels less than 78 dBA, and preferably between 70 and 76 dBA, under these operating conditions.

The invention further includes a method of operating a fan constructed in accordance with the present invention, including providing the fan, supplying electrical power to the fan, and actuating the electric motor to drive the impeller. The method thus produces airflow through the fan that achieves the above-mentioned advantages of the present invention.

The invention has been described in connection with what are presently considered to be the most practical and preferred embodiment. However, the present invention has been presented by way of illustration and is not intended to be limited to the disclosed embodiments. Accordingly, those skilled in the art will realize that the invention is intended to encompass all modifications and alternative arrangements included within the spirit and scope of the invention, as set forth by the appended claims.

We claim:

1. An axially extending inline centrifugal fan for circulating air within an ambient environment, the fan comprising:

(A) a conduit having an intake end and an outlet end;

(B) an inlet cone disposed at the intake end for receiving air from the ambient environment;

(C) an impeller disposed downstream of the inlet cone and including:

(i) a centrally disposed wheel-back configured for rotation by an electric motor;

(ii) a plurality of fan blades extending radially outwardly from the wheel-back operable to force air in the direction from the intake end to the outlet end; and (iii) a wheel cone fixedly attached to, and circumscribing the wheel blades; and (D) a drive chamber disposed downstream of the impeller including a plurality of radially extending straightening vanes operable to receive the forced air from the impeller and direct the air substantially axially downstream to the outlet end; wherein the inlet cone has a discharge diameter of substantially 0.75 times a diameter defined by radial outermost edges of opposing fan blades;

wherein the inlet cone has an axial length substantially between 0.17 and 0.21 times the diameter defined by the radial outermost edges of opposing fan blades.

2. An inline centrifugal mixed flow fan for circulating air within an ambient environment, the fan comprising:

(A) a conduit having an intake end and an outlet end;

(B) an inlet cone disposed at the intake end for receiving air from the ambient environment;

(C) an impeller including:

(i) a wheel-back configured for rotation by an electric motor;

(ii) a plurality of fan blades extending radially outwardly from the wheel-back operable to force air in the direction from the intake end to the outlet end; and (iii) a wheel cone attached to and circumscribing the wheel blades; and (D) a drive chamber disposed downstream of the impeller including a plurality of straightening vanes operable that receive the forced air from the impeller and direct the air substantially axially downstream to the outlet end; wherein the fan is capable of producing sound pressure at a level less than 70 dBA when producing an airflow at a rate between 4100 and 6100 cubic feet per minute at substantially one inch water gauge of fan static pressure.

3. The fan as recited in claim 2, wherein the inlet cone has an axial length substantially between 0.17 and 0.21 times the diameter defined by the radial outermost edges of opposing fan blades.

4. An axially extending inline centrifugal mixed flow fan for circulating air within an ambient environment, the fan comprising:

(A) a conduit having an intake end and an outlet end;

(B) an inlet cone disposed at the intake end for receiving air from the ambient environment;

(C) an impeller including:

(i) a wheel-back configured for rotation by an electric motor;

(ii) a plurality of fan blades extending radially outwardly from the wheel-back operable to force air in the direction from the intake end to the outlet end; and (iii) a wheel cone attached to and circumscribing the wheel blades; and (D) a drive chamber disposed downstream of the impeller including a plurality of straightening vanes operable that receive the forced air from the impeller and direct the air substantially axially downstream to the outlet end; wherein the fan is capable of achieving an efficiency greater than 60% when producing an airflow at a rate between 4100 and 6100 cubic feet per minute at 2 inches water gauge of static pressure.

5. The fan as recited in claim 4, wherein the inlet cone has an axial length substantially between 0.17 and 0.21 times the diameter defined by the radial outermost edges of opposing fan blades.

6. An inline centrifugal mixed flow fan for circulating air within an ambient environment, the fan comprising:

(A) a conduit having an intake end and an outlet end;

(B) an inlet cone disposed at the intake end for receiving air from the ambient environment;

(C) an impeller including:

(i) a wheel-back configured for rotation by an electric motor;

(ii) a plurality of fan blades extending radially outwardly from the wheel-back operable to force air in the direction from the intake end to the outlet end; and (iii) a wheel cone attached to and circumscribing the wheel blades; and (D) a drive chamber disposed downstream of the impeller including a plurality of straightening vanes operable that receive the forced air from the impeller and direct the air substantially axially downstream to the outlet end; wherein the fan is capable of achieving sound pressure levels less than 78 dBA when producing an airflow at a rate between 4100 and 20000 cubic feet per minute at 3 inches of water gauge static pressure.

7. The fan as recited in claim 6, wherein the inlet cone has an axial length substantially between 0.17 and 0.21 times the diameter defined by the radial outermost edges of opposing fan blades.

8. An axially extending inline centrifugal fan for circulating air within an ambient environment, the fan comprising:

(A) a housing defining a conduit having an intake end and an outlet end;

(B) an inlet cone disposed at the intake end for receiving air from the ambient environment;

(C) an impeller including:

(i) a centrally disposed wheel-back configured for rotation by an electric motor;

(ii) a plurality of fan blades extending radially outwardly from the wheel-back operable to force air in the direction from the intake end to the outlet end;

(iii) a wheel cone fixedly attached to, and circumscribing the wheel blades;

(D) a drive chamber disposed downstream of the impeller including a plurality of radially extending straightening vanes operable to receive the forced air from the impeller and direct the air substantially axially downstream to the outlet end; and (E) a modular bearing assembly extending within the conduit including a shaft that is driven by the electric motor to drive the impeller, first and second bearing plates supported by the housing that both receive the shaft therein, and first and second bearings coupled to the first and second bearing plates, respectively, to interlock the shaft and bearing plates with respect to axial movement and facilitate relative rotation between the shaft and the bearing plates, wherein the bearing plates are removable from the conduit to remove the bearing assembly as a unitary assembly.

9. The axially extending inline centrifugal fan as recited in claim 8, further comprising:

a duct connector disposed proximal the intake end unitary with the conduit and configured to provide a slip-fit connection with ductwork in a building.

10. The centrifugal fan as recited in claim 8, further comprising a first and second annular flange presenting corresponding mounting surfaces to which the first and second bearing plates are attached.

11. The centrifugal fan as recited in claim 10, wherein the first and second annular flanges are disposed in the drive chamber.

12. The centrifugal fan as recited in claim 8, wherein the first and second bearings are connected to outer faces of the first and second bearing plates.

13. An axially extending inline centrifugal fan for circulating air within an ambient environment, the fan comprising:

(A) a conduit having an intake end and an outlet end;

(B) an inlet cone disposed at the intake end for receiving air from the ambient environment;

(C) an impeller including:

(i) a centrally disposed wheel-back configured for rotation by an electric motor;

(ii) a plurality of fan blades extending radially outwardly from the wheel-back operable to force air in the direction from the intake end to the outlet end, each of the blades having a leading edge disposed upstream of a trailing edge, wherein each blade is trapezoidal and has a uniform thickness and a radius of curvature substantially between 0.7 and 0.86 times the diameter defined by radial outermost edges of opposing fan blades; and (iii) a wheel cone fixedly attached to the outer periphery of the wheel blades; and (D) a drive chamber disposed downstream of the impeller including a plurality of radially extending straightening vanes operable to receive the forced air from the impeller and direct the air substantially axially downstream to the outlet end.

14. An axially extending inline centrifugal fan for circulating air within an ambient environment, the fan comprising:

(A) a conduit having an intake end and an outlet end;

(B) an inlet cone disposed at the intake end for receiving air from the ambient environment;

(C) an impeller including:

(i) a centrally disposed wheel-back configured for rotation by an electric motor, wherein the wheel-back includes a substantially spherical portion formed from a radius of substantially between 0.37 and 0.45 times the diameter defined by radial outermost edges of opposing fan blades;

(ii) a plurality of fan blades extending radially outwardly from the wheel-back operable to force air in a direction from the intake end to the outlet end; and (iii) a wheel cone fixedly attached to, and circumscribing the wheel blades; and (D) a drive chamber disposed downstream of the impeller including a plurality of radially extending straightening vanes operable to receive the forced air from the impeller and direct the air substantially axially downstream to the outlet end.

15. An axially extending inline centrifugal fan for circulating air within an ambient environment, the fan comprising:

(A) a conduit having an intake end and an outlet end;

(B) an inlet cone disposed at the intake end for receiving air from the ambient environment;

(C) an impeller disposed downstream of the inlet cone that rotates to circulate air, the impeller including:

(i) a centrally disposed wheel-back configured for rotation by an electric motor;

(ii) a plurality of fan blades extending radially outwardly from the wheel-back having a leading edge and a trailing edge operable to force air in the direction from the intake end to the outlet end; and (iii) a wheel cone fixedly attached to, and circumscribing the wheel blades; and (D) a drive chamber disposed downstream of the impeller including a plurality of radially extending straightening vanes operable to receive the forced air from the impeller and direct the air substantially axially downstream to the outlet end, wherein each of the fan blades extend radially outwardly from the wheel-back at a wheel-back edge, and are connected to the wheel cone at a wheel cone edge, and wherein a blade angle between 22° and 32° is formed between the wheel-back edge proximal the leading edge and a line extending tangentially with respect to wheel-back at the interface between the wheel-back and leading edge in the direction of wheel-back rotation.

16. The fan as recited in claim 15, wherein the blade angle is approximately 27°.

17. An axially extending inline centrifugal fan for circulating air within an ambient environment, the fan comprising:

(A) a conduit having an intake end and an outlet end;

(B) an inlet cone disposed at the intake end for receiving air from the ambient environment;

(C) an impeller disposed downstream of the inlet cone that rotates to circulate air, the impeller including:

(i) a centrally disposed wheel-back configured for rotation by an electric motor;

(ii) a plurality of fan blades extending radially outwardly from the wheel-back having a leading edge and a trailing edge operable to force air in the direction from the intake end to the outlet end; and (iii) a wheel cone fixedly attached to, and circumscribing the wheel blades; and (D) a drive chamber disposed downstream of the impeller including a plurality of radially extending straightening vanes operable to receive the forced air from the impeller and direct the air substantially axially downstream to the outlet end, wherein each of the fan blades extend radially outwardly from the wheel-back at a wheel-back edge, and are connected to the wheel cone at a wheel cone edge, and wherein a blade angle between 35° and 45° is formed between the wheel-back edge proximal the trailing edge and a line extending tangentially with respect to wheel-back at the interface between the wheel-back and the trailing edge in the direction of wheel-back rotation.

18. The fan as recited in claim 17, wherein the blade angle is approximately 40°.

19. An axially extending inline centrifugal fan for circulating air within an ambient environment, the fan comprising:

(A) a conduit having an intake end and an outlet end;
(B) an inlet cone disposed at the intake end for receiving air from the ambient environment;
(C) an impeller disposed downstream of the inlet cone that rotates to circulate air, the impeller including:
(i) a centrally disposed wheel-back configured for rotation by an electric motor;
(ii) a plurality of fan blades extending radially outwardly from the wheel-back having a leading edge and a trailing edge operable to force air in the direction from the intake end to the outlet end; and
(iii) a wheel cone fixedly attached to, and circumscribing the wheel blades; and
(D) a drive chamber disposed downstream of the impeller including a plurality of radially extending straightening vanes operable to receive the forced air from the impeller and direct the air substantially axially downstream to the outlet end,
wherein each of the fan blades extend radially outwardly from the wheel-back at a wheel-back edge, and are connected to the wheel cone at a wheel cone edge, and wherein a blade angle between 22° and 32° is formed between the wheel cone edge proximal the leading edge and a line extending tangentially with respect to wheel cone at the interface between the wheel cone and the leading edge in the direction of wheel cone rotation.

20. The fan as recited in claim 19, wherein the blade angle is approximately 27°.

21. An axially extending inline centrifugal fan for circulating air within an ambient environment, the fan comprising:
(A) a conduit having an intake end and an outlet end;
(B) an inlet cone disposed at the intake end for receiving air from the ambient environment;
(C) an impeller disposed downstream of the inlet cone that rotates to circulate air, the impeller including:
(i) a centrally disposed wheel-back configured for rotation by an electric motor;
(ii) a plurality of fan blades extending radially outwardly from the wheel-back having a leading edge and a trailing edge operable to force air in the direction from the intake end to the outlet end; and
(iii) a wheel cone fixedly attached to, and circumscribing the wheel blades; and
(D) a drive chamber disposed downstream of the impeller including a plurality of radially extending straightening vanes operable to receive the forced air from the impeller and direct the air substantially axially downstream to the outlet end,
wherein each of the fan blades extend radially outwardly from the wheel-back at a wheel-back edge, and are connected to the wheel cone at a wheel cone edge, and wherein a blade angle between 27° and 37° is formed between the wheel cone edge proximal the trailing edge and a line extending tangentially with respect to wheel cone at the interface between the wheel cone and the trailing edge in the direction of wheel cone rotation.

22. The fan as recited in claim 21, wherein the blade angle is approximately 32°.

23. An axially extending inline centrifugal fan for circulating air within an ambient environment, the fan comprising:
(A) a conduit having an intake end and an outlet end;
(B) an inlet cone disposed at the intake end for receiving air from the ambient environment;
(C) an impeller including:
(i) a centrally disposed wheel-back configured for rotation by an electric motor;
(ii) a plurality of fan blades extending radially outwardly from the wheel-back operable to force air in the direction from the intake end to the outlet end; and
(iii) a wheel cone fixedly attached to, and circumscribing the wheel blades; and
(D) a drive chamber disposed downstream of the impeller including a plurality of radially extending straightening vanes operable to receive the forced air from the impeller and direct the air substantially axially downstream to the outlet end, wherein each of the straightening vanes includes a pair of tabs extending from locations proximal leading and trailing edges of the vanes into a pair of corresponding elongated slots extending through the drive chamber to properly orientate the straightening vanes with respect to the drive chamber.

24. An axially extending inline centrifugal fan for circulating air within an ambient environment, the fan comprising:
(A) a conduit having an intake end and an outlet end;
(B) an inlet cone disposed at the intake end for receiving air from the ambient environment;
(C) an impeller disposed downstream of the inlet cone and including:
(i) a centrally disposed wheel-back configured for rotation by an electric motor;
(ii) a plurality of fan blades extending radially outwardly from the wheel-back operable to force air in the direction from the intake end to the outlet end; and
(iii) a wheel cone fixedly attached to, and circumscribing the wheel blades; and
(D) a drive chamber disposed downstream of the impeller including a plurality of radially extending straightening vanes operable to receive the forced air from the impeller and direct the air substantially axially downstream to the outlet end;
wherein the inlet cone has an axial length substantially between 0.17 and 0.21 times the diameter defined by the radial outermost edges of opposing fan blades and the inlet cone has a throat diameter between 0.61 and 0.75 times the diameter defined by the radial outermost edges of the opposing fan blades.

* * * * *